US010306936B2

(12) United States Patent
Kreft

(10) Patent No.: US 10,306,936 B2
(45) Date of Patent: Jun. 4, 2019

(54) OPENABLE HANDWEAR

(71) Applicant: Michelle A. Kreft, Laingsburg, MI (US)

(72) Inventor: Michelle A. Kreft, Laingsburg, MI (US)

( * ) Notice: Subject to any disclaimer, the term of this patent is extended or adjusted under 35 U.S.C. 154(b) by 812 days.

(21) Appl. No.: 14/829,687

(22) Filed: Aug. 19, 2015

(65) Prior Publication Data

US 2016/0302498 A1 Oct. 20, 2016

Related U.S. Application Data

(60) Provisional application No. 62/149,895, filed on Apr. 20, 2015.

(51) Int. Cl.
*A41D 19/01* (2006.01)
*A41D 19/00* (2006.01)

(52) U.S. Cl.
CPC ..... *A41D 19/01* (2013.01); *A41D 19/002* (2013.01); *A41D 19/0017* (2013.01)

(58) Field of Classification Search
CPC ..... A41D 19/01; A41D 19/0017; A41D 19/002
See application file for complete search history.

(56) References Cited

U.S. PATENT DOCUMENTS 2,274,335 A * 2/1942 Kennedy ..... A41D 19/01 2/158
2,315,889 A * 4/1943 Wells ..... A41D 19/0017 2/158
2,323,136 A * 6/1943 Johanson ..... A41D 19/01 2/158
2,451,837 A * 10/1948 La Londe ..... A41D 19/01 2/158
3,299,441 A * 1/1967 Slimovitz ..... A41D 19/0017 2/158

(Continued)

OTHER PUBLICATIONS

International Search Report and Written Opinion of the International Searching Authority from corresponding Patent Cooperation Treaty Application No. PCT/US2016/015342, dated Mar. 31, 2016.

*Primary Examiner* — Richale L Quinn
(74) *Attorney, Agent, or Firm* — Gardner, Linn, Burkhart & Ondersma LLP

(57) ABSTRACT

An openable handwear article provides adjustable levels of insulation and exposure of a wearer's hand for cold-weather outdoors activities, and particularly fitness activities. The openable handwear allows a wearer to regulate the temperature and comfort of the wearer's hand and wrist during fitness activities. The openable handwear has one inner chamber shaped to hold a loosely closed hand or a loose fist, and overlapping layers on a palm side to quickly gain practically full use of the hand, optionally without using the other hand to pull back the fabric. Optionally, the overlapping layers form storage pockets to store personal items. The openable handwear can assume at least three or four different configurations to regulate heat, comfort, and usability of the wearer's hand, depending on the outdoor conditions and fitness activity. The configurations include a fully enclosed configuration, a partially opened configuration, and a fully retracted configuration.

19 Claims, 8 Drawing Sheets

(56) References Cited

U.S. PATENT DOCUMENTS

| | | | | | |
|---|---|---|---|---|---|
| 3,403,408 | A * | 10/1968 | Helfer | A41D 19/0017 | 2/158 |
| 4,383,336 | A * | 5/1983 | Beckman | A41D 19/01 | 2/158 |
| 4,651,350 | A | 3/1987 | Dawiedczyk | | |
| 4,933,992 | A * | 6/1990 | Kallman | A41D 19/00 | 2/158 |
| 5,172,427 | A * | 12/1992 | Van Bergen | A41D 19/01 | 2/123 |
| 5,509,143 | A * | 4/1996 | Yates | A41D 19/01535 | 2/158 |
| 5,617,583 | A | 4/1997 | Yates et al. | | |
| 6,338,163 | B1 * | 1/2002 | Markson | A41D 19/0017 | 2/161.6 |
| 6,581,211 | B1 | 6/2003 | Golden | | |
| 6,810,530 | B2 | 11/2004 | Bryant, Sr. | | |
| 7,117,541 | B2 * | 10/2006 | Hozack | A41D 19/01594 | 2/161.5 |
| 7,290,291 | B2 | 11/2007 | Anderson et al. | | |
| D709,666 | S | 7/2014 | Willows et al. | | |
| D712,120 | S | 9/2014 | Willows et al. | | |
| 8,904,566 | B2 | 12/2014 | Clark | | |
| 9,220,307 | B2 * | 12/2015 | Clayton | A41D 19/01 | |
| 9,456,644 | B2 * | 10/2016 | Willows | A41D 19/002 | |
| 2006/0212989 | A1 | 9/2006 | White | | |
| 2008/0222773 | A1 | 9/2008 | Vaughn | | |
| 2012/0311766 | A1 * | 12/2012 | Clark | A41D 19/01 | 2/158 |
| 2014/0082825 | A1 * | 3/2014 | Clark | A41D 19/01 | 2/158 |
| 2014/0250565 | A1 * | 9/2014 | Willows | A41D 19/002 | 2/160 |

* cited by examiner

OPENABLE HANDWEAR

CROSS REFERENCE TO RELATED APPLICATION

The present application claims the benefit of U.S. provisional application Ser. No. 62/149,895, filed Apr. 20, 2015, which is hereby incorporated herein by reference in its entirety.

FIELD OF THE INVENTION

The present invention relates to adjustable fitness handwear.

BACKGROUND

Typical gloves and mittens provide insulation and weather-resistant properties for the wearer, but do not facilitate shared warmth of the palm, fingers, and thumb encased by the glove or mitten. Heat produced by these body parts is lost to the fabric touching the various parts of the hand. Additionally, gloves and mittens do not allow access to the bare hand and typically must be entirely removed in order to have full use of the exposed hand. In some cases, excess clothing is worn at the start of cold weather activity to maintain a comfortable body temperature before the body is fully warmed up, but the excess clothing (such as gloves or mittens) later becomes unnecessary as the wearer's body produces extra heat during fitness activities. Thus, when an athlete's body temperature increases due to fitness activities, the excess clothing that provided comfort at the beginning of the activities can become unnecessary and may increase the risk of overheating and dehydration. The athlete then may wish to remove the clothing and set it down while risking its loss, or may hold onto the removed clothing during the remaining fitness activities, which can be uncomfortable.

SUMMARY OF THE INVENTION

The present invention provides a cold-weather outdoors handwear article that is particularly suited for fitness activities. Specifically, the handwear article is openable to facilitate regulating the temperature and comfort of a wearer's hand and wrist during fitness activities. Furthermore, the handwear article can be folded back over the hand and thus retained on the wearer's wrist during running or other fitness activities to facilitate cooling and use of the hands, to prevent loss of the article, and may be used to clear sweat from the wearer's brow or forehead. Optionally, the article also includes pockets to store personal items such as keys, credit cards, or hand warmers during running or other fitness activities.

The handwear article has at least three configurations, and optionally four or five configurations, for regulating heat and comfort of the wearer's hand, depending on the outdoor conditions and level of fitness activity. Notably, it is envisioned that the handwear article does not have separate or divided chambers for individual digits (fingers or the thumb). Instead, the article has one inner chamber shaped to hold the wearer's hand in a loose fist or fist-like shape, and has overlapping fabric layers on a palm side that allow the wearer to quickly gain practically full use of the wearer's uncovered hand. This may be accomplished without using the wearer's other hand to pull back the article. In a first configuration, the handwear article encloses the wearer's hand, and allows the hand to be in a relaxed or loose fist to conserve heat and warm the wearer's fingers and thumb with their palm.

The first configuration further allows the wearer to keep their hand in a common and natural curled finger position as for running. In a second configuration the wearer's fingers exit through the palm side opening, optionally remaining in a relaxed or loose fist position, allowing increased airflow and heat escape. In a third configuration the wearer's fingers and thumb exit through an opening of the handwear article, such as by using only the hand that is wearing the handwear, such that the wearer gains practically full use of their hand. In a fourth configuration, the article is pulled or folded back on itself at a palm side to further expose the wearer's hand so that the wearer has substantially unobstructed use of their hand and their wrist. In a fifth configuration, the article is further pulled back to fully expose the wearer's hand and wrist.

According to one form of the present invention, the handwear article includes a back panel and a palm panel that cooperate to define a chamber. The chamber receives a wearer's hand in a fist-like shape and encloses the hand without any portions of the handwear article interspaced between the fingers. The palm panel defines an opening that is open to the chamber. The handwear article is reconfigurable or repositionable from a configuration that completely encloses the wearer's hand in the chamber, to another configuration in which the wearer pulls the handwear article proximally (i.e. toward the elbow), such that it lies inside out against the wearer's forearm.

In one aspect, the opening defined in the palm panel is positioned adjacent to the wearer's fingers to allow the hand to open the opening and extend from the chamber using only the fingers of the hand that is wearing the handwear.

In another aspect, the handwear article also includes one or more pockets that are accessible next to the opening in the palm panel. Optionally, the palm panel forms at least part of one of the pockets.

According to another form of the present invention, a handwear article is made up of a set of panels including a back panel, a proximal palm panel, and a distal palm panel that cooperate to define an internal chamber. The back panel has a proximal end portion, a distal end portion, and opposing sides that extends between the proximal and distal end portions. Likewise, the proximal palm panel and the distal palm panel each have a respective proximal end portion, a distal end portion, and opposing sides. The opposing sides of the proximal palm panel are coupled to respective opposing sides of the back panel, and the distal end portion of the proximal palm panel terminates between the proximal and distal end portions of the back panel. The distal palm panel has a proximal end portion, a distal end portion, and opposing sides. The distal end portion of the distal palm panel is coupled to the distal end portion of the back panel. The proximal end portion of the distal palm panel overlaps and terminates proximally of the distal end portion of the proximal palm panel.

In one aspect, the back panel, the proximal palm panel, and the distal palm panel define the chamber, which receives the wearer's hand in a fist-like shape through an opening. The opening is formed in a palm side of the chamber between the proximal end portion of the distal palm panel and the distal end portion of the proximal palm panel.

Thus, the handwear article provides insulation and weather resistance when disposed fully around the wearer's hand, permitting the hand to be held in a relaxed or loose fist-like shape with the fingers curled to conserve heat with the palm, and without excessive material extending loosely a significant distance beyond the knuckles, for comfort at least at the start of fitness activities in cold weather. The handwear article has a slot or opening formed between overlapping palm-side panels, which allows the wearer to work the fingers of the hand that is wearing the article out through the opening to expose at least the fingertips, and to optionally expose more of the fingers or most of the hand, as desired. This may be done to enhance the wearer's ability to grip objects or cool the hand, for example. The handwear article can be drawn further back to expose more of the wearer's hand as desired, to provide even further increased cooling and less obstructed or completely unobstructed use of the hand.

These and other objects, advantages, purposes and features of this invention will become apparent upon review of the following specification in conjunction with the drawings.

DESCRIPTION OF THE PREFERRED EMBODIMENTS

Figure 1:
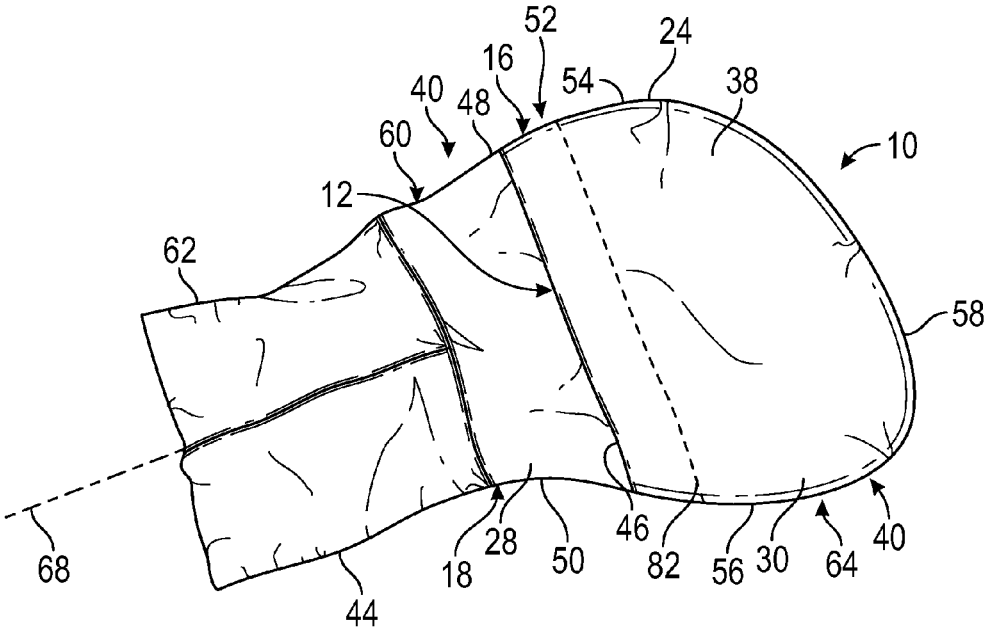
FIG. 1 is a palm or inner side view of a right-hand handwear article according to the present invention.
Figure 2:
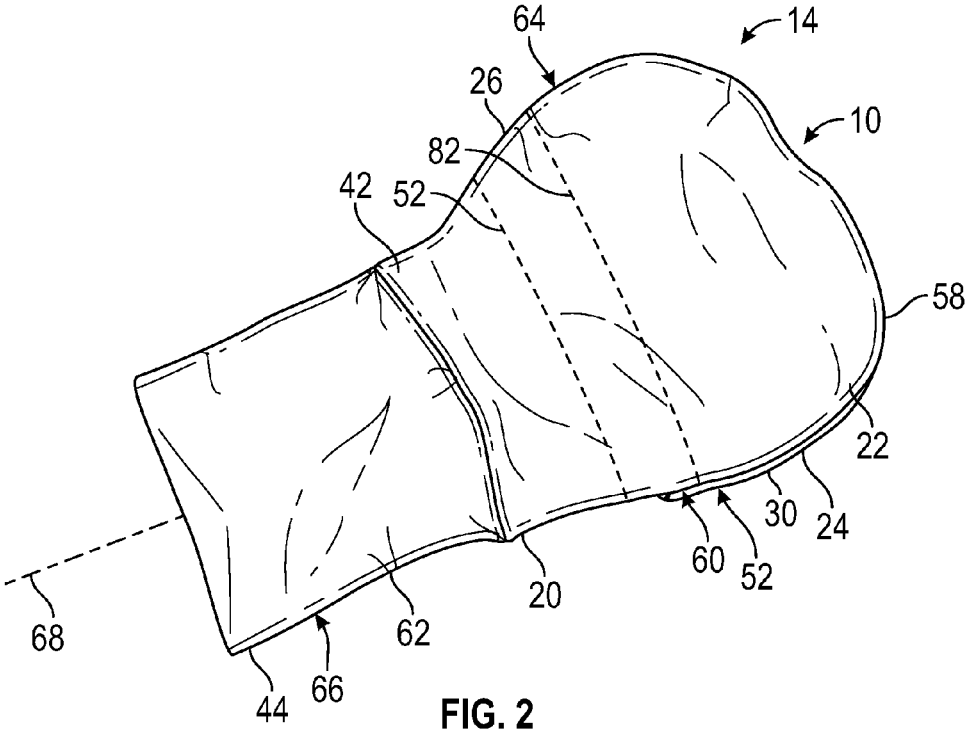
FIG. 2 is a back-of-hand or outer side view of the handwear article of FIG. 1.
Figure 3:
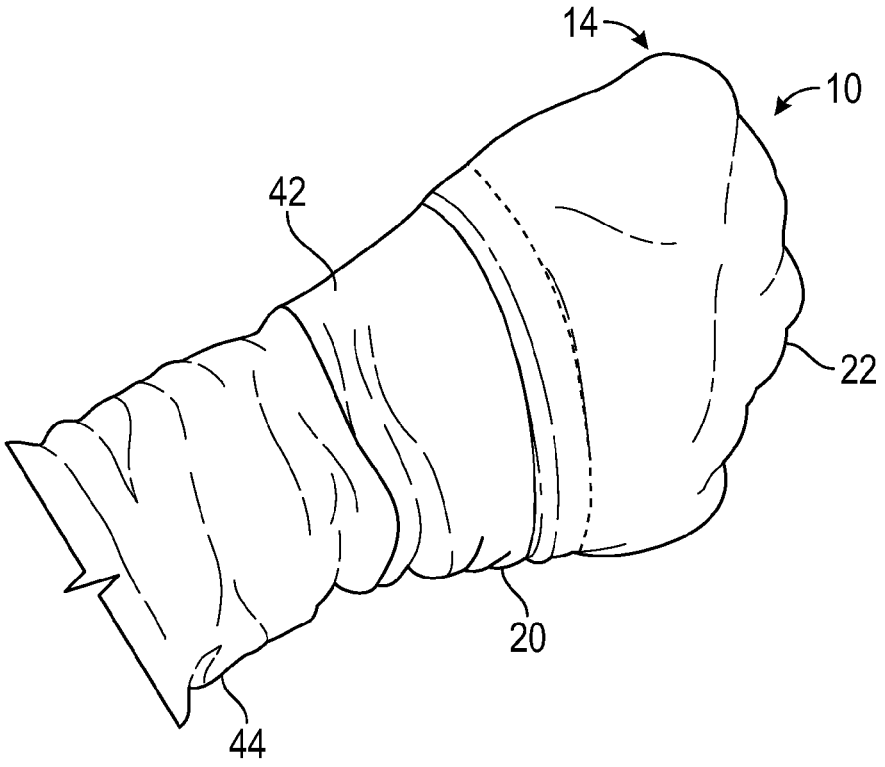
FIG. 3 is a back-of-hand or outer side view of the handwear article with the wearer's right hand inserted therein.

Referring now to the drawings and illustrated embodiments depicted therein, particularly FIGS. 1-3, an openable handwear article 10 is provided for a hand H of a wearer (FIGS. 4-8 and 11-14), such as for use outdoors in a cold and/or wet environment. The handwear article 10 is particularly suited for running and other outdoor athletic activities to regulate the temperature and comfort of the wearer's hand H and wrist. The handwear article 10 can be retained on the wearer's wrist during running or other fitness activities to prevent loss, to store personal items, to cool the hands, or to clear sweat from the wearer's brow or forehead, and to facilitate replacing the article 10 on the wearer's hand H. Optionally, the handwear article 10 may include one or more storage pockets or pouches to store personal items such as keys, credit cards, or handwarmers, as will be described below in more detail.

Figure 9:
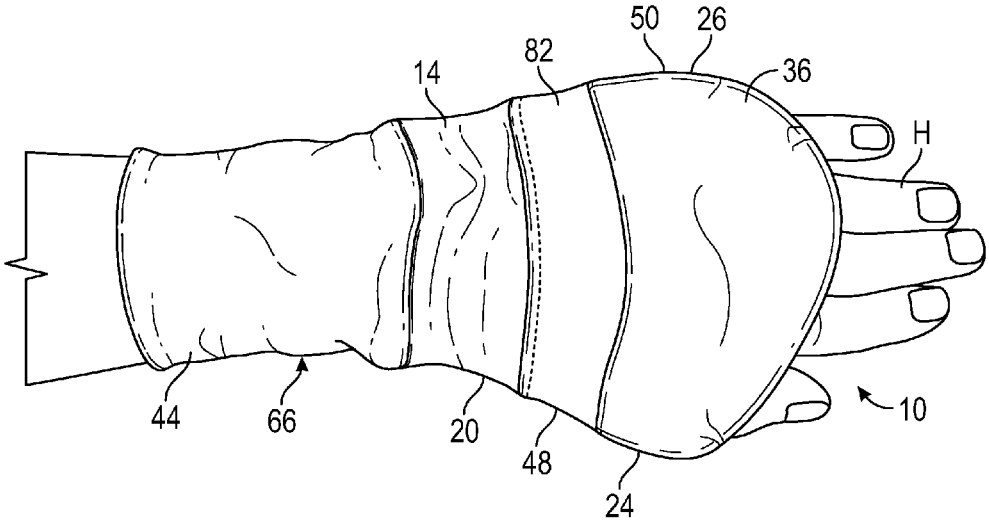
FIG. 9 is a back-of-hand or outer side view of the hand in the handwear article, in which an outer flap is folded back over itself and inside-out or partially retracted, such that the fingers are generally free of the handwear article.
Figure 10:
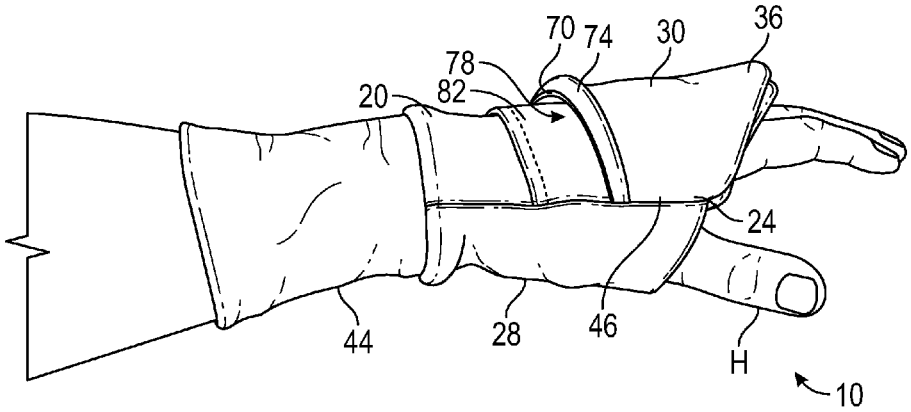
FIG. 10 is a side view of the hand in the handwear article in the configuration of FIG. 9.
Figure 11:
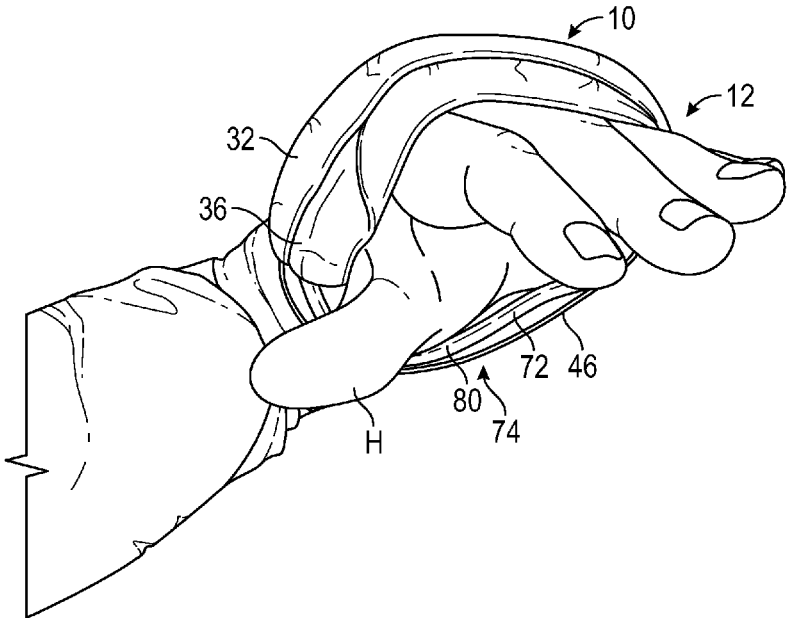
FIG. 11 is a fingertip or end view of the hand in handwear article in the configuration of FIG. 9.
Figure 12:
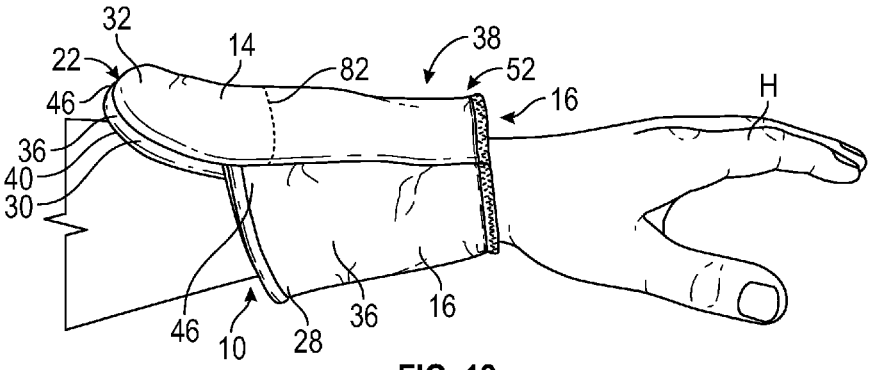
FIG. 12 is a side view of the hand in the handwear article with the outer flap fully retracted over itself and cuffed.
Figure 13:
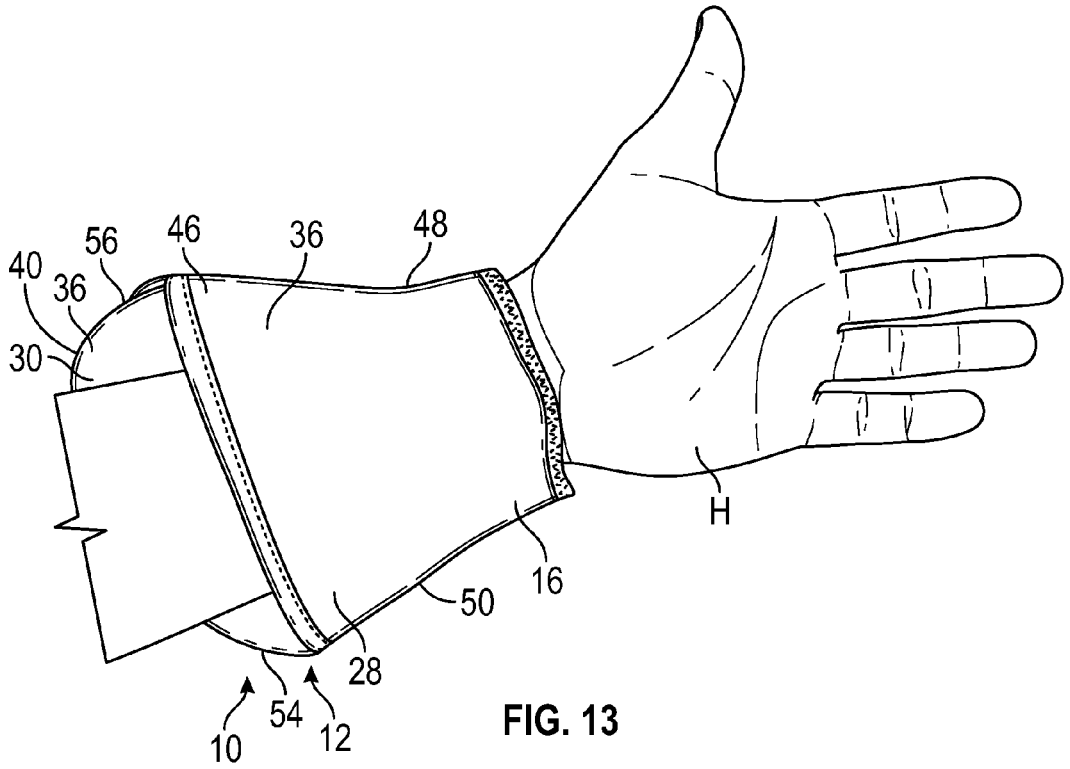
FIG. 13 is a bottom view of the hand in the handwear article in the configuration of FIG. 12.

In a first or substantially fully closed configuration, handwear article 10 allows the wearer to have their hand H in a loose fist or fist-like shape (FIGS. 3 and 14) to conserve heat and warm their fingers and thumb with their palm. The first configuration further allows the wearer to keep their hand H in a common and natural curled or loose fist-like position such as may be desired for running. The handwear article 10 allows the wearer's digits (fingers and thumb) to work out from an opening 12 of the handwear article 10 to expose the fingertips in a second configuration (FIGS. 1 and 4), such that the wearer gains cooling to the interior of the handwear 10 and, optionally, may have limited use of the uncovered fingertips. In a third configuration the fingers are fully nearly fully exposed for full dexterity (FIGS. 5-8), allowing practically full use of their hand H in the third configuration. A fourth configuration (FIG. 9-11) allows the wearer to gain further use of their hand H and their wrist. A fifth configuration (FIG. 12-13) is achieved by drawing a portion of the handwear article 10 further back over the wrist to provide uninhibited motion and use of the wrist and hand H.

As illustrated in FIGS. 1, 2, 4, and 14, the handwear article 10 is assembled from a back panel 14 and a two-piece palm panel 16 that cooperate to define a hand chamber 18. The back panel 14 has a proximal end portion 20, a distal end portion 22, and opposing sides 24, 26 that extend between the proximal end portion 20 and distal end portion 22. The two-piece palm panel 16 is made up of a proximal palm panel 28 and a distal palm panel 30. A proximal portion of the distal palm panel 30 overlaps a distal portion of the proximal palm panel 28 to define the opening 12, such as shown in FIGS. 1 and 2. Each of the panels 14, 16 are sewn together at opposing sides 24, 26 and thereby cooperate to define the hand chamber 18. The back panel 14 and two-piece palm panel 16 may be sewn together, or can be mechanically joined in any suitable manner, such as with adhesive or other suitable bonding material or process.

The chamber 18 (FIG. 14) is formed by joining the back panel 14 and two-piece palm panel 16 to receive the wearer's hand H in the fist-like shape to conserve heat and warm the wearer's fingers, thumb, and palm. Chamber 18 encloses the wearer's hand H without any portions of the handwear article 10 interspaced between any fingers or thumb of the wearer's hand H. As shown in FIGS. 9, 10, 12, and 13, the back panel 14 has an inner portion or surface 32 and an outer portion or surface 34, and the two-piece palm panel 16 has an inner portion or surface 36 and an outer portion or surface 38. In at least one configuration, such as the first configuration of FIG. 14, the inner portions 32, 36 are interior surfaces that cooperate to define the chamber 18 and the outer portions 34, 38 are outer surfaces exposed to the environment. Thus, the chamber 18 is formed as a single cavity that is shaped to fit the wearer's hand H in a loose fist, which allows the wearer to keep their hand H in a common and natural position for running, for example.

Back panel 14 and the two-piece palm panel 16 cooperate to substantially form the fist-like shape of chamber 18. For example, and with reference to FIGS. 1-3, distal end portion 22 of the back panel 14 and a distal end portion 40 of the two-piece palm panel 16 are wider than respective proximal end portions 20, 42 of the back panel 14 and the two-piece palm panel 16. Each proximal end portion 20, 42 couples to a wrist panel 44 that is configured to encircle at least a portion of the wearer's wrist.

Figure 7:
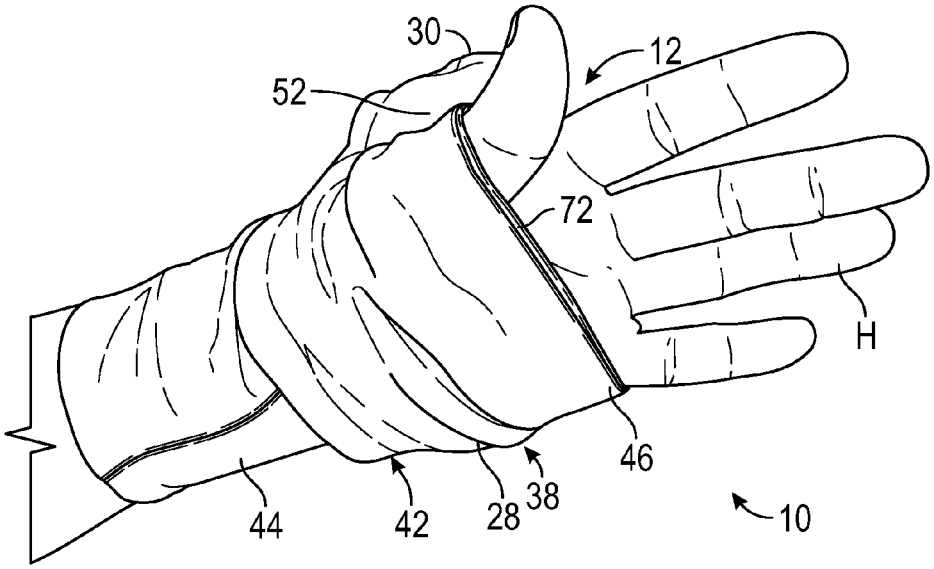
FIG. 7 is a palm or inner side view of the hand in the handwear article in the configuration of FIG. 5.
Figure 8:
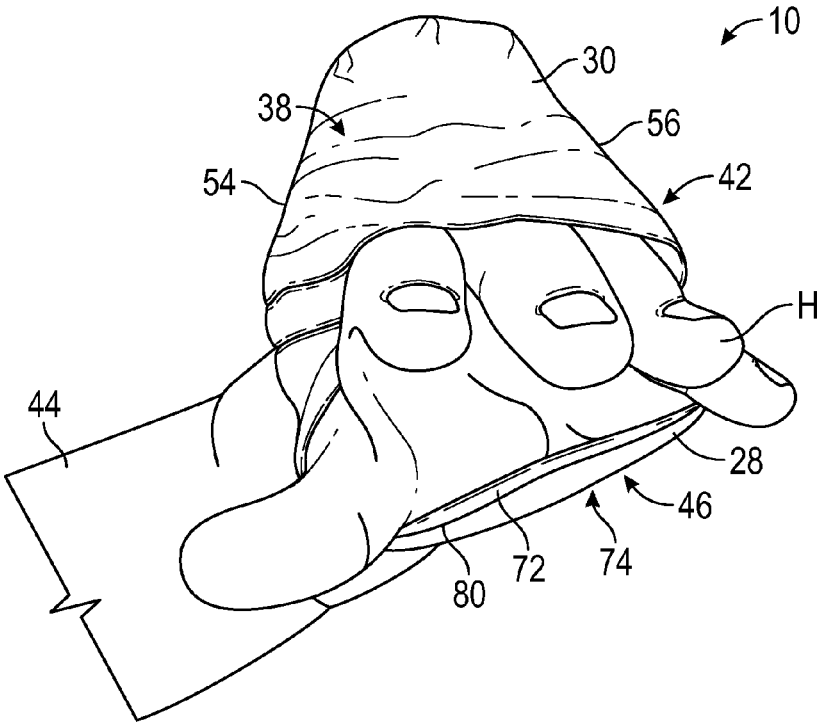
FIG. 8 is a fingertip or end view of the hand in the handwear article in the configuration of FIG. 5.

The proximal palm panel 28 is generally adjacent to the wearer's palm and has the proximal end portion 42, a distal end portion 46 and opposing sides 48, 50 (FIG. 7). The opposing sides 48, 50 of the proximal palm panel 28 are coupled to respective opposing sides 24, 26 of the back panel 14. The distal end portion 46 of the proximal palm panel 28 terminates between a proximal end portion 52 of the distal palm panel 30 and the distal end portion 40 of the distal palm panel 30. Thus, the proximal end portion 52 of distal palm panel 30 overlies or overlaps distal end portion 46 of proximal palm panel 28 to form opening 12 when the handwear article 10 is in the first configuration of FIGS. 1-4 and 14.

The distal palm panel 30 is generally adjacent to the wearer's fingers, and in addition to proximal end portion 52 and distal end portion 40, the distal palm panel 30 has opposing sides 54, 56. The opposing sides 54, 56 of the distal palm panel 30 are coupled to respective opposing sides 24, 26 of the back panel 14. The distal end portion 40 of the distal palm panel 30 is coupled to a distal end portion 22 of the back panel 14. In addition, the proximal end portion 52 of distal palm panel 30 overlaps the distal end portion 46 of the proximal palm panel 28.

The fist-like shape of the handwear article 10 is further defined by a substantially asymmetric perimeter 58 (FIG. 2). A seam is formed along the perimeter 58 where opposing sides 54, 56 of the distal palm panel 30 are coupled to respective opposing sides 24, 26 of the back panel 14. The seam has an outboard portion 60 that is substantially in line with an outboard edge 62 of the wrist panel 44. The seam further has an inboard portion 64 that forms an arcuate shape about the distal end portions 22, 40 of the back panel 14 and the two-piece palm panel 16 that is opposite the outboard portion 60. Therefore, the handwear article 10 has a substantially asymmetric shape along a centerline 68 of the wrist panel 44, such as shown in FIG. 1.

The opening 12 allows the wearer's fingers to cool when there is less need to conserve heat. For example, the wearer may have less need to conserve heat while running or during another fitness activity, or while indoors or in a heated area. Specifically, the opening 12 allows the wearer to work their fingers, thumb, and wrist out of the article 10 to cool, such as shown in FIGS. 4-12. In addition, the opening 12 allows the wearer to fully use their hand H. The opening 12 is generally formed as a slot between the proximal end portion 52 of the distal palm panel 30 and the distal end portion 46 of the proximal palm panel 28. In the illustrated embodiment, opening 12 extends substantially across the entire width of handwear 10. Thus, the opening 12 is defined in the two-piece palm panel 16 and is configured to permit the wearer's hand H to reach through the opening 12 (see FIGS. 4-13) from the chamber 18 of the handwear article 10. The opening 12 is generally positioned adjacent to the wearer's fingers to allow the wearer's hand H to extend out of the chamber 18 through the opening 12 using only the fingers or thumb of the wearer's hand H.

Each inner portion 32, 36 and outer portion 34, 38 is generally composed of a fabric such as cotton, wool, fleece, or the like. It is generally desirable that the inner portions 32, 36 of article 10 are soft and have insulating and/or moisture-wicking properties. It is also generally desirable that the outer portions 34, 38 have water- or wind-resistant properties, thus the outer portions 34, 38 may be composed of wool, polyester, nylon, or other fabrics. It will be appreciated that each portion 32, 34, 36, 38 can be composed of different materials to have different uses for different intended purposes, such as for cold or wet conditions.

Figure 14:
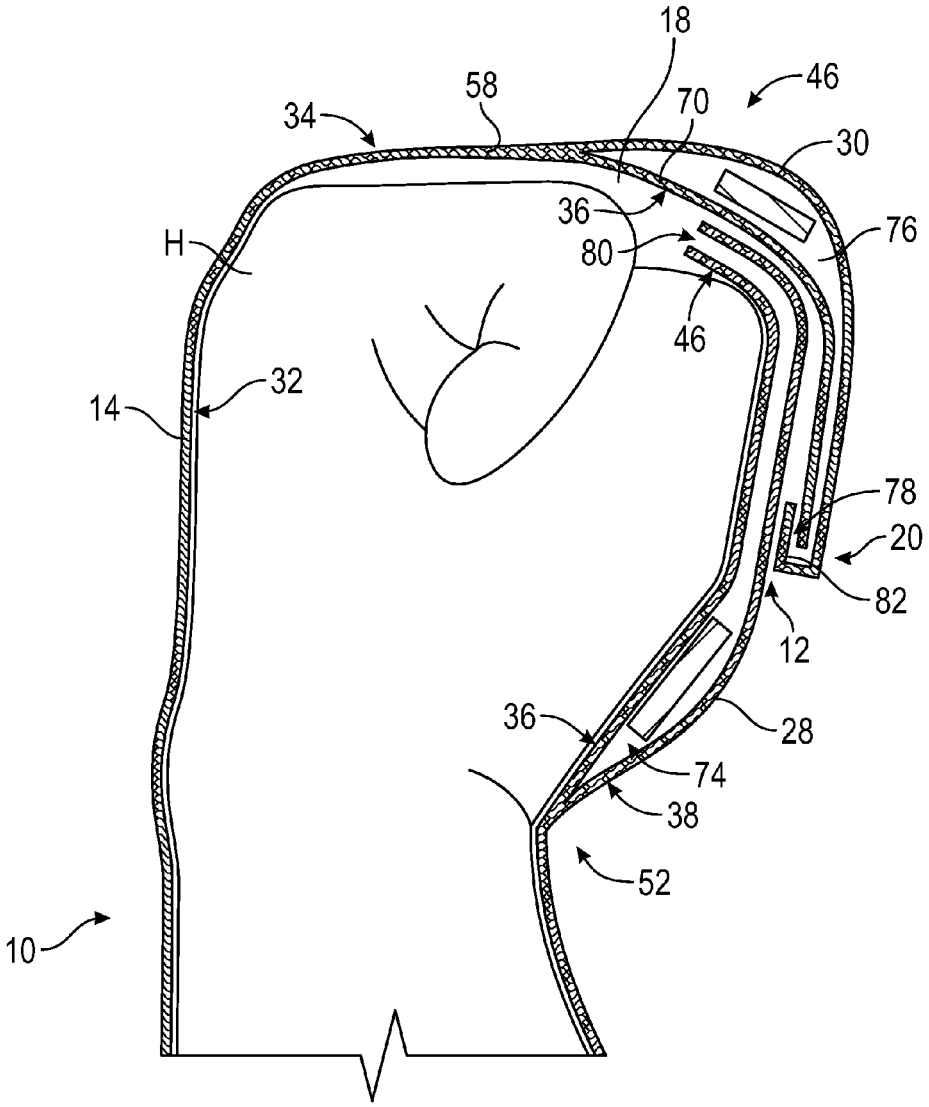
FIG. 14 is a cross-sectional view of the handwear article of FIG. 3 with the hand in a fist-like shape.

In the illustrated embodiment, and as best shown in FIG. 14, the inner portion 32 of back panel 14 cooperates with a distal pocket panel 70 to form a distal pocket 76, and the inner portion 36 of the two-piece palm panel 16 cooperates with a proximal pocket panel 72 to form a proximal pocket 74. The wearer may access the distal pocket 76 via a distal pocket opening 78 and may access the proximal pocket 74 via a proximal pocket opening 80. The pockets 74, 76 are accessible when the handwear article 10 is in any of the first through fifth configurations, by opening the respective pocket openings 80, 78 with the user's fingers of hand H that is in the article 10, or with the user's other hand. The distal pocket 76 is formed by the distal palm panel 30 and the distal pocket panel 70, which cooperate to form the distal pocket opening 78 adjacent to the opening 12 and the palm of the hand H when in the first configuration. The proximal pocket 74 is formed by the proximal palm panel 28 and the proximal pocket panel 72, which cooperate to form the proximal pocket opening 80 adjacent to the end of opening 12 that is in the handwear interior (i.e., at chamber 18) and near the fingers when in the first and second configurations, and along the palm of the hand H when in the third and fourth configurations.

Each pocket 74, 76 is sewn at the perimeter 58 of the handwear article 10 and may be sewn at least partially inboard from seams 60, 64. However, each of the openings 78, 80 is sufficiently wide to allow the wearer to store and remove personal items from the pockets 74, 76. Thus, the proximal pocket opening 80 is formed at the distal end portion 46 of the proximal palm panel 28, and the distal pocket opening 78 is formed at the proximal end portion 20 of the distal palm panel 30. In the illustrated embodiment, the distal pocket 76 has a flap 82 to cover or partially block the distal pocket opening 78 to prevent personal items from unintentionally exiting the distal pocket 76. One would understand that the proximal pocket 74 could also have a flap to cover or partially block the proximal pocket opening 80. Thus, the distal pocket 76 has a similar shape and perimeter as the distal palm panel 30, and the proximal pocket 74 has a similar shape and perimeter as the proximal palm panel 28.

As noted above, the handwear article 10 is capable of assuming multiple configurations that provide differing and selectable amounts of exposure of the wearer's hand H for cooling and use of the hand. Each configuration allows the wearer to have their hand H in the fist-like shape, which is commonly a natural position for running and other fitness activities. In the first configuration (FIGS. 1-3 and 14), the handwear article 10 receives the wearer's hand H in the fist-like shape to enclose the hand H. Specifically, the chamber 18 of the handwear article 10 receives the wearer's hand H through the wrist panel 44, and the wrist panel 44 at least partially encircles the wearer's wrist. The distal palm panel 30 conceals the proximal pocket opening 80 and the flap 82. However, the distal pocket 76 and the proximal pocket 74 are still accessible to the wearer's other hand through opening 12, or by the wearer's fingers on hand H within the chamber 18. Thus, in the first configuration the wearer's hand H is received in the single chamber 18, without any panel or portion of the handwear article 10 located between the wearer's fingers and thumb.

Figure 4:
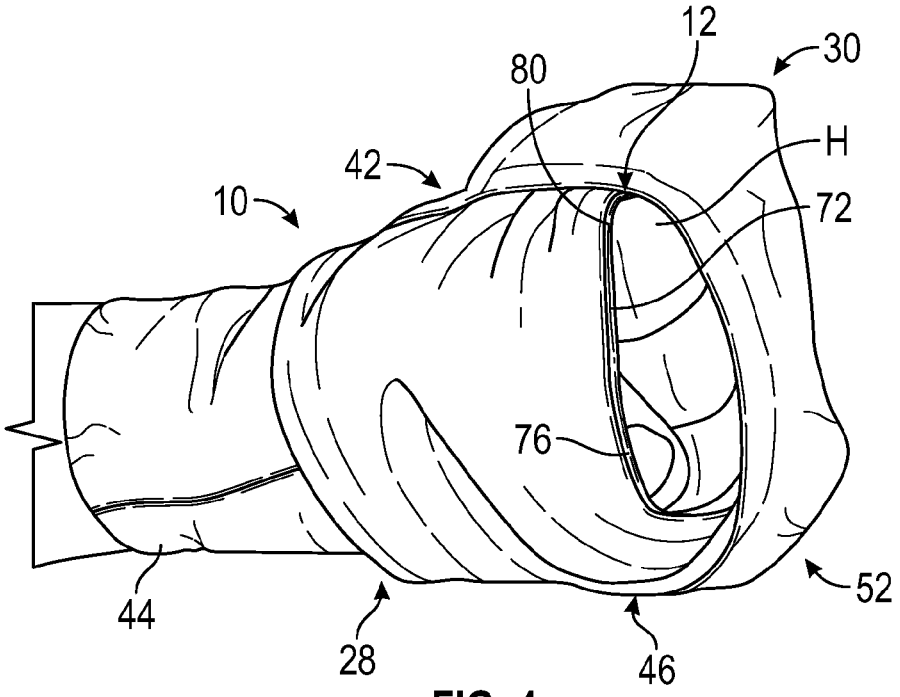
FIG. 4 is a palm or inner side view of the handwear article, shown with fingers working out from a fist position through an opening.
Figure 5:
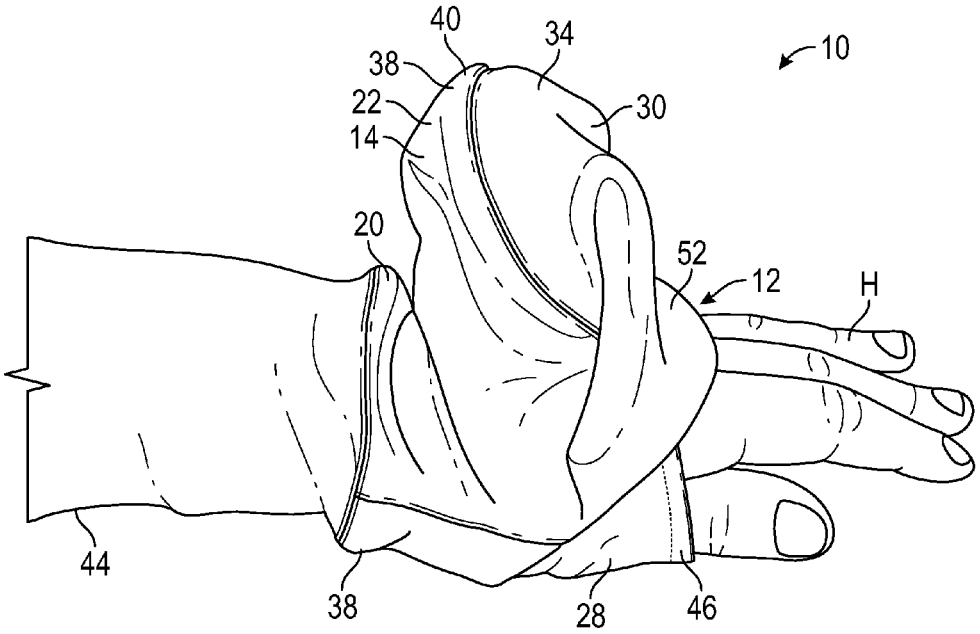
FIG. 5 is a side view of the hand in the handwear article, shown with fingers free of the handwear article and having at least limited use.
Figure 6:
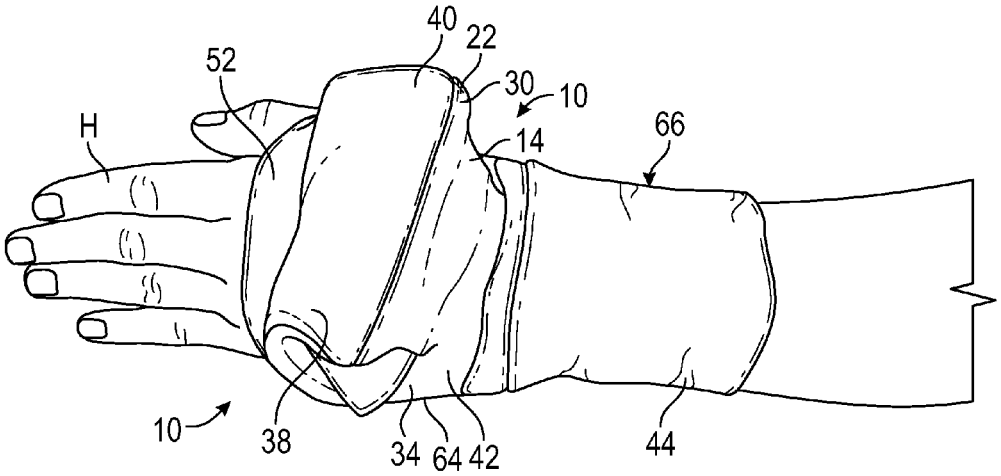
FIG. 6 is a back-of-hand or outer side view of the hand in the handwear article in the configuration of FIG. 5.

In a second configuration, illustrated in FIG. 4, the wearer's hand H begins in the fist-like shape of the first configuration, from which the wearer's fingers or thumb extend from the chamber 18 through the opening 12. Optionally, it may be possible for the wearer to use only the fingers of the hand H that is wearing the article 10 to expose portions of the wearer's hand H through the opening 12, without need for grasping the handwear article 10 with the other hand. In the second configuration of FIG. 4, the proximal pocket opening 80 is open to the environment, but the flap 82 is still concealed by the distal palm panel 30. However, the distal pocket 76 and the proximal pocket 74 are accessible to the wearer's other hand through opening 12, or by manipulating the wearer's fingers on hand H within the chamber 18. Thus, the second configuration allows the wearer to increase ventilation of hand H to regulate temperature while still wearing the handwear article 10.

To achieve the third configuration, illustrated in FIG. 5-8, the wearer's hand H begins in the fist-like shape of the first configuration and the fingers are worked at least partially out through the opening 12 as in the second configuration, from which the wearer's fingers and then palm extend outwardly from the chamber 18 and through the opening 12, which is generally adjacent to the fingers. Optionally, it may be possible for the wearer to use only the fingers of the hand H wearing the article 10 to more fully expose the wearer's hand H through the opening 12, without need for grasping the handwear article 10 with another hand. Thus, the third configuration allows the wearer to gain practically full use of their partially-exposed or mostly-exposed hand H while still wearing the handwear article 10 about the wrist, the back of the hand, and the heel of the palm.

Furthermore, the third configuration allows the wearer to increase ventilation and conserve less heat when desired, such as while running or during other fitness activities. As noted above the third configuration still covers the wrist and a substantial portion of the wearer's hand H, and may cover at least a heel portion of the wearer's palm that is proximal to the wearer's wrist (FIGS. 5-8). In the third configuration, the proximal pocket opening 80 is open to the environment, but the flap 82 is concealed by the distal palm panel 30 as in the first and second configurations. The distal pocket 76 and the proximal pocket 74 are still accessible to the wearer's other hand through opening 12, or by the wearer's fingers of hand H within the chamber 18. Thus, the third configuration encloses a portion of the wearer's hand H and wrist to conserve some heat, allow use of the hand H, and retain the handwear article 10 on the wrist during running or other fitness activities.

To achieve the fourth configuration (FIGS. 9-11) from the third configuration, the proximal end portion 52 of distal palm panel 30 is pulled distally from the wearer's hand H, typically using the wearer's other hand (not shown) to grasp the back panel 14 and the distal palm panel 30. The proximal end portion 52 is folded back over itself and onto the distal end portion 22 of the back panel 14 and toward the wearer's wrist, which essentially turns the handwear article 10 partially inside-out. Therefore, the fourth configuration is generally less obtrusive to the wearer's hand H and wrist movement than the second and third configurations. Compared to the third configuration, the fourth configuration also conserves less heat and allows for greater ventilation while retaining the handwear article 10 on the wearer during running or other fitness activities.

It will be appreciated that the fourth configuration substantially exposes at least the inner portion 32 of the back panel 14 to the outside environment. In the fourth configuration of FIGS. 9-11, the distal pocket opening 78 and the flap 82, which conceals the distal pocket opening 78, are open or at least more exposed to the environment. Specifically, in the fourth configuration the flap 82 and the distal pocket opening 78 are positioned on the back of the wearer's hand H adjacent to the back panel. The proximal pocket 74 and the proximal pocket opening 80 are still accessible to the wearer's other hand or, to a limited extent, by the wearer's fingers on hand H within the proximal portion of the chamber 18 that is still defined between the proximal palm panel 28 and back panel To achieve a fifth configuration (FIGS. 12 and 13), the article 10 begins in the fourth configuration and the wearer further pulls the handwear article 10 in the proximal direction (i.e., towards the elbow) to turn the handwear article 10 substantially inside-out, with the distal end portion 22 of the back panel 14, the distal end portion 40 of the distal palm panel 30, and the distal end portion 46 of the proximal palm panel 28 all facing rearwardly or proximally (i.e., toward the wearer's elbow) with their interior surfaces 32, 36 exposed to the outside environment. The handwear article 10 is pulled further from the wearer's hand H to cover only the wearer's wrist and lay against the wearer's forearm, such that the article 10 lies flat against the wearer's forearm. Thus, the fifth configuration also conserves less heat than the first, second, third, and fourth configurations while retaining the handwear article 10 to the wearer during running or other fitness activities. In the fifth configuration of FIGS. 12 and 13, the proximal pocket opening 80 is open to the environment and generally lies against the inside of the wearer's forearm. In the fifth configuration the wearer stores and removes personal items from the proximal pocket 74 with the wearer's other hand. The distal pocket opening 78 and flap 82 are concealed by the back panel 14, adjacent to the back side or outside of the wearer's wrist.

The wearer may return article 10 to the first configuration from any of the second through fifth configurations by generally reversing the steps noted above. For example, to return the article to the fourth configuration from the fifth configuration the wearer pulls the handwear article 10 in the distal direction (i.e., towards the fingers) to turn the handwear article 10 partially inside-in so the distal end portion 40 of the distal palm panel 30, the distal end portion 22 of the back panel 14, and the distal end portion 46 of the proximal palm panel 28 all facing rearwardly or proximally (i.e., toward the wearer's elbow) all face forwardly or distally (i.e., toward the fingers). To return the article to the third configuration from the fourth configuration, the wearer pulls the proximal end portion 52 of distal palm panel 30 distally around the fingers to unfold the proximal end portion 52 from over back panel 14. To return the article to the second configuration from the third configuration the wearer's hand H generally forms the fist-like shape and the wearer's other hand pulls the article 10 so at least the palm of hand H is generally within the chamber 18. To return the article to the first configuration from the second configuration the wearer generally retracts the fingers of hand H through the opening 12 into the chamber 18 so that the opening 12 closes. It will be appreciated that returning handwear article 10 from the fifth configuration to the first configuration can generally be accomplished in two steps, where the first step involves pulling the distal ends 22, 40 of back panel 14 and the distal palm panel 30 forwardly (distally) from the fifth configuration to the third configuration, and the second step involves pulling the proximal end portion 52 of the distal palm panel 30 forwardly (distally) over and around the fingers while curling and retracting the fingers into chamber 18 and pulling the proximal end portion 52 rearwardly (proximally) to overlap the distal end portion 46 of proximal palm panel 28 in a relatively smooth and substantially continuous motion.

Accordingly, it will be appreciated that the handwear article 10 is particularly suited for running and other outdoor fitness activities to regulate the temperature and comfort of a wearer's hand H and wrist such as in cold or wet environments, and may also be used to store personal items. Furthermore, even when the handwear article 10 is removed from the wearer's hand H, it can be retained along the wearer's wrist and/or forearm during running or other fitness activities, or can be partially retracted to expose varying amounts of the wearer's hand to adjust for comfort, as desired.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A handwear article comprising:

a back panel and a palm panel cooperating to define a singular and continuous chamber formed to receive a wearer's hand in a close-hand position or a loose fist-like shape, wherein said chamber encloses the hand without any portions of the handwear article interspaced between any digits of the hand, said palm panel comprising a distal palm panel and a proximal palm panel;

wherein said chamber comprises a proximal inlet opening and one and only one outlet opening, said one and only one outlet opening positioned adjacent to the wearer's digits to allow the hand to extend out of said chamber through said one and only one outlet opening; and a storage pocket partially defined by said distal palm panel or said proximal palm panel and having a substantially similar shape as said distal palm panel or said proximal palm panel, respectively, said storage pocket having a pocket opening adjacent to said one and only one outlet opening.

2. The handwear article of claim 1, wherein a portion of said proximal palm panel overlaps a portion of said distal palm panel.

3. The handwear article of claim 2, wherein said distal palm panel terminates at said one and only one outlet opening proximal to a center of the wearer's hand when the wearer's hand is in a fist-like shape.

4. The handwear article of claim 1, wherein said storage pocket is partially defined by said distal palm panel, and the said handwear article further comprises another storage pocket partially defined by said proximal palm panel.

5. The handwear article of claim 1, wherein said chamber has a distal end and a proximal end, wherein said distal end is wider than said proximal end, and the handwear article further comprising a wrist portion attached to said proximal end that is configured to encircle at least a portion of the wearer's wrist.

6. The handwear article of claim 5, wherein said chamber has an outboard edge that is substantially in line with an edge of said wrist portion, and an inboard edge that forms an arcuate shape about said chamber, wherein said inboard edge is generally opposite said outboard edge, whereby the handwear article has an asymmetric shape across a centerline of said wrist portion.

7. The handwear article of claim 6, wherein said outboard edge comprises a seam where said back panel is coupled to said palm panel.

8. The handwear article of claim 6, wherein said inboard edge, said outboard edge, and an edge of the wrist portion partially defines a seam that defines a perimeter of the handwear article.

9. The handwear article of claim 1, wherein said chamber is an undivided cavity that is substantially defined by respective inner portions of said back panel and said palm panel.

10. A handwear article comprising:

a back panel having a proximal end portion, a distal end portion, and opposing sides extending between said proximal and distal end portions;

a proximal palm panel having a proximal end portion, a distal end portion, and opposing sides, wherein said opposing sides of said proximal palm panel are coupled to respective ones of said opposing sides of said back panel, and wherein said distal end portion of said proximal palm panel terminates between said proximal and distal end portions of said back panel;

a distal palm panel having a proximal end portion, a distal end portion, and opposing sides, wherein said opposing sides of said distal palm panel are coupled to respective ones of said opposing sides of said back panel, said distal end portion of said distal palm panel is coupled to said distal end portion of said back panel, and said proximal end portion of said distal palm panel overlaps said distal end portion of said proximal palm panel;

a first pocket and a second pocket, wherein said first pocket is partially defined by said distal palm panel and said second pocket is partially defined by said proximal palm panel;

a chamber defined between said back panel, said proximal palm panel, and said distal palm panel, wherein said chamber is configured to receive a wearer's hand in a fist-like shape; and an opening formed in a palm side of said chamber and defined between said proximal end portion of said distal palm panel and said distal end portion of said proximal palm panel, wherein said opening is configured to permit the wearer's hand to reach through said opening from said chamber.

11. The handwear article of claim 10, wherein the handwear article is positionable so that said distal end portion of said back panel and said distal palm panel are drawn away from the wearer's digits such that said distal end portion of said back panel and said distal palm panel are substantially inside out and lie against a back of the wearer's hand.

12. The handwear article of claim 10, wherein the handwear article is positionable so that the handwear article is substantially turned inside-out against a back of the wearer's forearm, wherein said distal end portion of said back panel and said distal end portion of said distal palm panel are pulled to face outwardly.

13. The handwear article of claim 10, wherein each of said pockets defines a respective pocket opening adjacent to said opening.

14. A handwear article comprising:

a back panel and a palm panel cooperating to define a singular and continuous chamber configured to receive a wearer's hand in a fist-like shape, wherein said chamber encloses the hand without any portions of the handwear article interspaced between any digits of the hand, said palm panel comprising a distal palm panel and a proximal palm panel;

wherein said chamber comprises a proximal inlet opening and one and only one outlet opening, said one and only one outlet opening positioned adjacent to the wearer's digits to allow the hand to extend out of said chamber through said one and only one outlet opening; and a pocket comprising a pocket opening adjacent to said one and only one outlet opening, and wherein said pocket is partially defined by said distal palm panel or said proximal palm panel;

wherein the handwear article is configurable from one configuration in which the wearer's hand is completely enclosed in said chamber, to another configuration in which the handwear article is pulled distally from the wearer's hand such that the handwear article is inside out and lies against a forearm of the wearer.

15. The handwear article of claim 14, wherein a portion of said proximal palm panel overlaps a portion of said distal palm panel, and wherein said distal palm panel terminates at said one and only one outlet opening proximal to a center of the wearer's hand when the wearer's hand is in a fist-like shape.

16. The handwear article of claim 15, wherein said pocket is integrally formed with said distal palm panel, and the handwear article further comprises another pocket formed with said proximal palm panel.

17. The handwear article of claim 16, wherein the handwear article is positionable so that said back panel and said palm panel are directed away from the wearer's digits such that said back panel and said palm panel are substantially inside out and lie against a back of the wearer's hand.

18. The handwear article of claim 16, wherein said back panel and said palm panel cooperate to define a perimeter having an outboard edge that is substantially in line with an edge of a wrist portion, and an inboard edge that forms an arcuate shape about said chamber, wherein said inboard edge is generally opposite said outboard edge, whereby the handwear article has an asymmetric shape across a centerline of said wrist portion.

19. The handwear article of claim 16, wherein the handwear article is positionable so that the handwear article is substantially turned inside-out against a back of the wearer's forearm, wherein said back panel and said distal palm panel are pulled to face proximally toward the wearer's elbow.

* * * * *